US009970315B2

(12) United States Patent
DiVincenzo et al.

(10) Patent No.: US 9,970,315 B2
(45) Date of Patent: May 15, 2018

(54) MOVABLE VANE CONTROL SYSTEM

(71) Applicant: Hamilton Sundstrand Corporation, Charlotte, NC (US)

(72) Inventors: Gregory DiVincenzo, Wethersfield, CT (US); Bhupindar Singh, West Hartford, CT (US); Francis P. Marocchini, Somers, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 307 days.

(21) Appl. No.: 14/621,009

(22) Filed: Feb. 12, 2015

(65) Prior Publication Data

US 2016/0356172 A1 Dec. 8, 2016

(51) Int. Cl.

| | |
|---|---|
| ***F04D 27/00*** | (2006.01) |
| ***F01D 17/16*** | (2006.01) |
| ***F01D 17/02*** | (2006.01) |
| ***F01D 9/04*** | (2006.01) |

(Continued)

(52) U.S. Cl.

CPC ..... *F01D 17/162* (2013.01); *F01D 9/041* (2013.01); *F01D 17/02* (2013.01); *F01D 21/003* (2013.01); *F04D 27/001* (2013.01); *F04D 27/002* (2013.01); *F04D 29/563* (2013.01); *F05D 2250/25* (2013.01)

(58) Field of Classification Search

CPC ..... F01D 17/162; F01D 9/041; F01D 17/02; F01D 21/003; F04D 27/001; F04D 27/002; F04D 29/563; F05D 2250/25

USPC ..... 415/1, 160; 324/207.11, 207.12, 207.14, 324/207.13, 207.25, 173

See application file for complete search history.

(56) References Cited

U.S. PATENT DOCUMENTS 4,773,817 A * 9/1988 Stangalini ..... F01D 11/001 415/127
5,165,844 A * 11/1992 Khalid ..... F01D 11/20 415/17

(Continued)

FOREIGN PATENT DOCUMENTS

EP 2006495 A1 6/2007
EP 1988258 A2 4/2008

(Continued)

OTHER PUBLICATIONS

Search Report regarding related EP App. No. 15100298/2, dated Jul. 22, 2016, 7 pgs.

*Primary Examiner* — Woody Lee, Jr.
*Assistant Examiner* — Brian Delrue
(74) *Attorney, Agent, or Firm* — Cantor Colburn LLP

(57) ABSTRACT

A movable vane control system is disclosed for use with a gas turbine engine having a turbine axis of rotation. The system includes a plurality of rotatable turbine vanes in a gas flow path within a turbine case of the gas turbine engine. A first vane position sensor having a first distance sensor is configured to sense the distance between the first distance sensor and a surface portion of a first of said plurality of vanes or a first movable target connected to the first vane. Additionally, the first distance sensor, the first vane surface portion, the first movable target, or a combination thereof is configured to provide a variable distance between the first distance sensor and the first vane surface portion or first movable target that varies as a function of a position of the first vane.

17 Claims, 5 Drawing Sheets

(51) Int. Cl.
*F01D 21/00* (2006.01)
*F04D 29/56* (2006.01)

(56) References Cited

U.S. PATENT DOCUMENTS 5,754,446 A * 5/1998 Fisher, Jr. ..... F03B 15/12 290/40 R
6,382,910 B1 * 5/2002 Kato ..... F01D 17/165 415/150
6,722,845 B2 * 4/2004 Chard ..... F01D 17/16 415/150
7,223,066 B2 * 5/2007 Rockley ..... F01D 17/162 415/160
8,066,474 B1 * 11/2011 Jansen ..... F01D 17/16 251/129.1
8,147,187 B2 * 4/2012 Foucher ..... F01D 17/162 384/192
9,033,654 B2 * 5/2015 Peck ..... F01D 17/162 415/160
2002/0034439 A1 * 3/2002 Caubet ..... F01D 17/16 415/160
2004/0017190 A1 * 1/2004 McDearmon ..... G01D 5/147 324/207.25
2008/0273965 A1 * 11/2008 Rajamani ..... F01D 17/02 415/129
2010/0172743 A1 * 7/2010 Bhatnagar ..... F04D 29/563 415/148
2010/0303612 A1 * 12/2010 Bhatnagar ..... F01D 11/22 415/127
2011/0026013 A1 * 2/2011 Funken ..... B60L 13/06 356/51
2011/0033297 A1 * 2/2011 Bouru ..... F04D 29/563 416/147
2012/0057958 A1 * 3/2012 Klingels ..... F01D 11/22 415/1
2012/0296593 A1 * 11/2012 Seccombe ..... F01D 11/14 702/94
2013/0315716 A1 * 11/2013 Cotroneo ..... F01D 11/22 415/130
2015/0240655 A1 * 8/2015 Hunt ..... F01D 17/00 415/1
2015/0367509 A1 * 12/2015 Georgeson ..... B64F 5/0045 700/258
2016/0010491 A1 * 1/2016 Singh ..... F01D 9/02 415/118
2016/0040550 A1 * 2/2016 Do ..... F01D 17/162 415/1
2016/0123238 A1 * 5/2016 Kay ..... F02C 9/20 415/1

FOREIGN PATENT DOCUMENTS

EP 2574733 A2 8/2012
GB 2466404 A * 6/2010 ..... F01D 11/22
WO 2014189574 A2 11/2014

* cited by examiner

MOVABLE VANE CONTROL SYSTEM

This invention was made with Government support under contract number N00014-09-D-0821 awarded by the United States Navy. The Government has certain rights in the invention.

BACKGROUND OF THE INVENTION

The present invention relates to gas turbine engines, and in particular, to positioning movable vanes on gas turbine engines. In some gas turbine engines, movable vanes are used to adjust the angle of air flow into turbine and compressor sections. This is typically accomplished using an actuator to rotate the movable vanes via a mechanical linkage. A sensor can be integrated with or connected to the actuator to provide feedback on the position of the actuator.

Sensors on the actuator can confirm the level of deployment of the actuator, but do not provide feedback on the actual angular position of the vanes. Because of errors in each link between the actuator and the movable vane, the position of the actuator may not be indicative of the position of the movable vane. Uncertainties in the angular position of movable vanes have lead engine designers to build additional margin into engine designs, leading to un-optimized fuel burn efficiencies, performance reductions due to compensation with turbine stage design, and premature engine repair.

The challenges for determining vane position can be especially difficult in the turbine section of a gas turbine engine. The space for location of the sensor is small. Additionally, the turbine vanes are in hot environment (greater than 1000° C.) and therefore the vane angle cannot be measured using conventional angle measurement sensors such as rotary variable differential transformers ("RVDTs") or resolvers. Also, the hot environment also creates challenges such as thermal expansion. At high temperatures, thermal expansion of the installation assembly is excessive which can introduce errors greater than 20% in gap measurements.

BRIEF DESCRIPTION OF THE INVENTION

According to the present invention, a movable vane control system for use with a gas turbine engine having a turbine axis of rotation comprises a plurality of turbine vanes in a gas flow path within a turbine case of the gas turbine engine. The vanes are rotatable along a vane axis to provide an angular adjustment of the vane with respect to the gas flow path. An actuator is operatively connected to the plurality of vanes. A first vane position sensor comprising a first distance sensor is configured to sense the distance between the first distance sensor and a surface portion of a first of said plurality of vanes or a first movable target connected to the first vane. Additionally, the first distance sensor, the first vane surface portion, the first movable target, or a combination thereof is configured to provide a variable distance between the first distance sensor and the first vane surface portion or first movable target that varies as a function of a position of the first vane.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
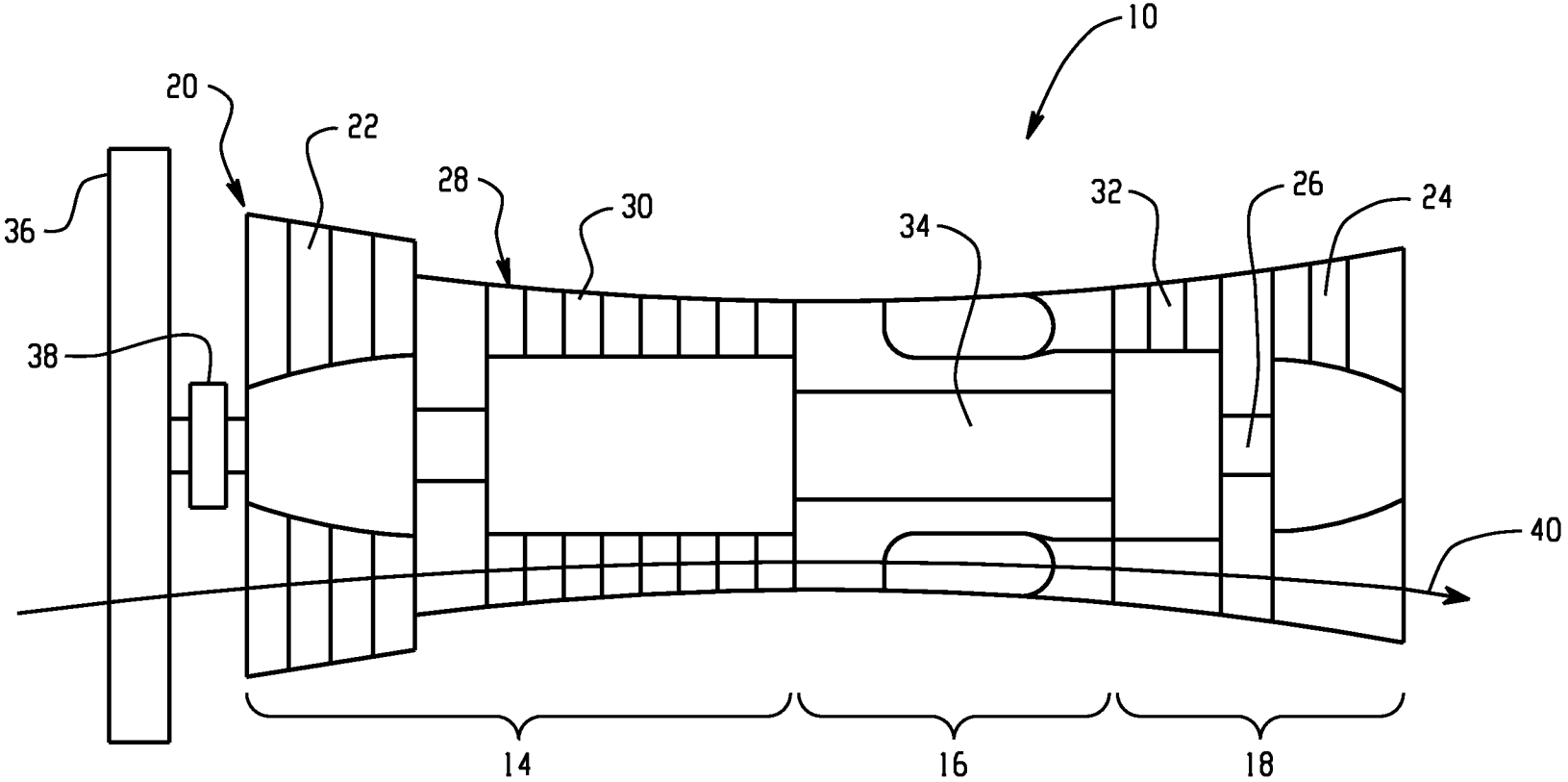
FIG. 1 is a schematic side view of a gas turbine engine.

FIG. 1 is a schematic side view of gas turbine engine 10. Gas turbine engine 10 includes compressor section 14, combustor section 16, and turbine section 18. Low pressure spool 20 (which includes low pressure compressor 22 and low pressure turbine 24 connected by low pressure shaft 26) and high pressure spool 28 (which includes high pressure compressor 30 and high pressure turbine 32 connected by high pressure shaft 34) each extend from compressor section 14 to turbine section 18. Propulsion fan 36 is connected to and driven by low pressure spool 20. A fan drive gear system 38 may be included between the propulsion fan 36 and low pressure spool 20. Air flows from compressor section 14 to turbine section 18 along engine gas flow path 40. In alternative embodiments, gas turbine engine 10 can be of a type different than that illustrated with respect to FIG. 1, such as a turboprop engine or an industrial gas turbine engine. The general construction and operation of gas turbine engines is well-known in the art, and does not require further detailed description herein.

Figure 2:
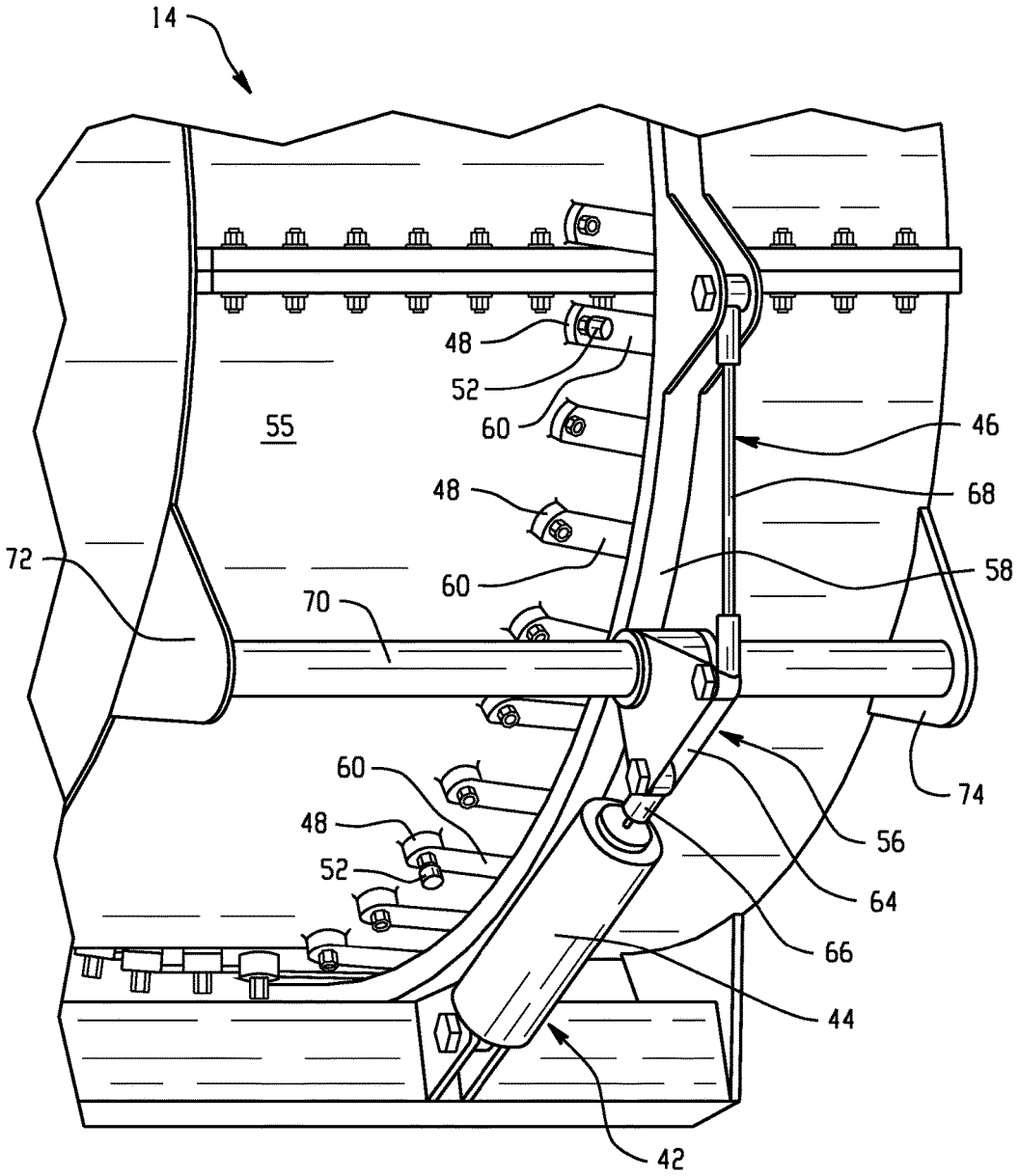
FIG. 2 is a schematic perspective view of a portion of a gas turbine engine including a movable vane control system.

FIG. 2 is a perspective view of a portion a gas turbine engine turbine section 14 including movable vane control system 42, which includes actuator 44, mechanical linkage assembly 46, movable vanes (not shown) connected to vane stems 48 that extend through case 55 of turbine section 14. Two of the movable vanes depicted in FIG. 2 have vane position sensors 52 associated therewith. Mechanical linkage assembly 46 includes torque converter 56, synchronization ring 58, and vane arms 60. In the illustrated embodiment, torque converter 56 includes crank 64 connected to actuator 44 via shaft 66 and connected to synchronization ring 58 via shaft 68. Torque converter 56 pivots on shaft 70, which extends between supports 72 and 74. In alternative embodiments, torque converter 56 can be another type of torque converter that functions to increase torque. Synchronization ring 58 is connected to the vane stems 48 via vane arms 60. In alternative embodiments, actuator 44 can be connected to movable vanes without use of synchronization ring 58.

Figure 3:
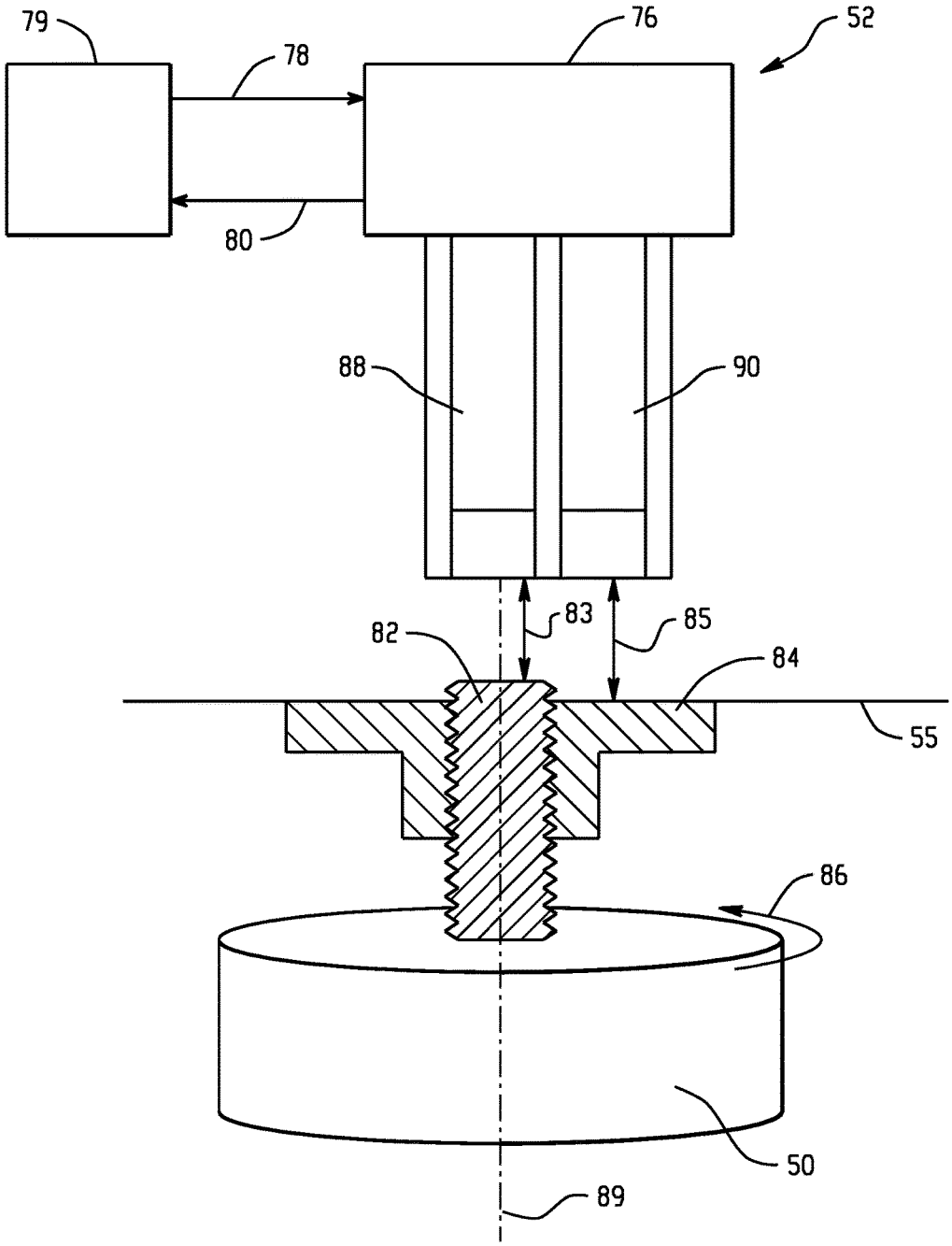
FIG. 3 is a schematic side view of a portion of a vane position detection portion of a movable vane control system including a movable target.

An exemplary vane position sensor that can be used as vane position 52 or 54 is depicted in FIG. 3. As shown in FIG. 3, vane position sensor 52 includes a distance sensor 76. Exemplary distance sensors include those that utilize an electromagnetic signal directed onto a target whose distance is to be detected, such as radio frequency (RF) distance sensors or microwave sensors by receiving an excitation signal 78 from controller 79 and returning an output signal 80. A movable target for the distance sensor 76 is provided by inner threaded member 82 (which can also serve as vane stem 48) that is disposed in outer threaded member 84 that is fixed to the turbine case 55. Inner threaded member 82 is operatively connected to blade 50 (only the end portion of blade 50 near the turbine case 55 is illustrated). By operatively connected, it is meant that the inner blade rotates along with the rotation of blade 50 in direction 86, although the actual physical connection can be direct or indirect. Distance sensor 76 also includes measuring waveguide 88, which directs a signal onto the inner threaded member 82, and reference waveguide 90 that directs a signal onto outer threaded member 84. Distance sensor 76 is mounted such that the distance 85 between it and the outer threaded member remains fixed during rotation of the vane 50. This is accomplished, for example, by fixedly mounting the distance sensor 76 to the turbine case 55. During rotation of the vane 50 in direction 86, the inner threaded member 82 also rotates in direction 86, and the action of the threads causes inner threaded member to move up or down along the vane's rotation axis 89 as a function of the degree of rotation. Distance sensor 76 measures the distance 83 between itself and the moving inner threaded member 82, which can be compared for reference against the measured distance 85 between the distance sensor 76 and the outer threaded member 84 to help compensate for effects of thermal expansion and other deformations that could affect the distance measurements by the distance sensor 76. In alternative embodiments, the distance sensor 76 can be mounted so that it maintains a fixed distance to the part of the movable member that is movable axially along the vane axis 89 (in this case inner threaded member 82). Computing the difference between the fixed target position and moving target position can reduce the effects of tolerance stack and thermal variation such as is experienced in the turbine section of a gas turbine engine. Using this configuration for measuring displacement will provide an accurate measurement of the vane position. In addition, it provides a friction free (zero dead-band) system of measurement as there are no contacting surfaces to affect the mechanical movement.

Figure 4:
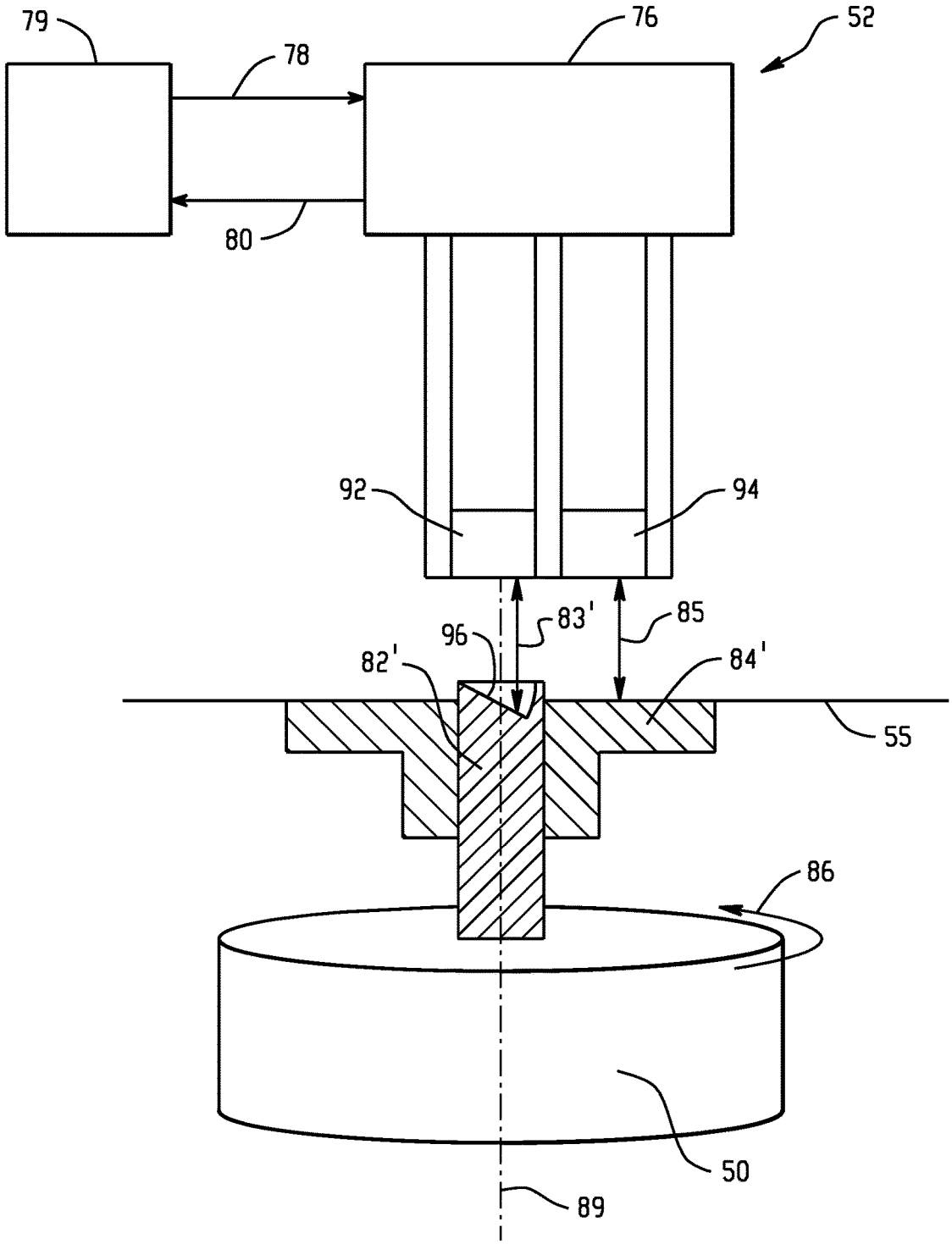
FIG. 4 is a schematic side view of a portion of a vane position detection portion of a movable vane control system that includes a movable target and a reference distance sensor.

Another exemplary embodiment of the vane position sensor 52 is shown in FIG. 4. FIG. 4 uses a similar component layout to FIG. 3 with like numbering of components, with a couple of differences. Instead of using measurement and reference waveguides, the FIG. 4 distance sensor 76 includes a separate measurement distance sensor 92 and a reference distance sensor 94. Also, inner member 82' and outer member 84' do not have threads to provide axial movement along the vane axis 89 as in FIG. 3. Instead, inner member includes a ramp portion 96 on a surface portion facing the distance sensor 76. Ramp portion 96 can be angled between 0° and 90° relative to the vane axis 89, or can even be an irregular shaped surface. When inner member 82' rotates along with rotation of the vane 50, the signal from measurement sensor 92 (or alternatively from a measurement waveguide such as in FIG. 3) will strike a different spot on the ramped surface portion 96 depending on the degree of rotation of the inner member 82', providing a measured distance 83' that varies as a function of the position of vane 50.

Figure 5:
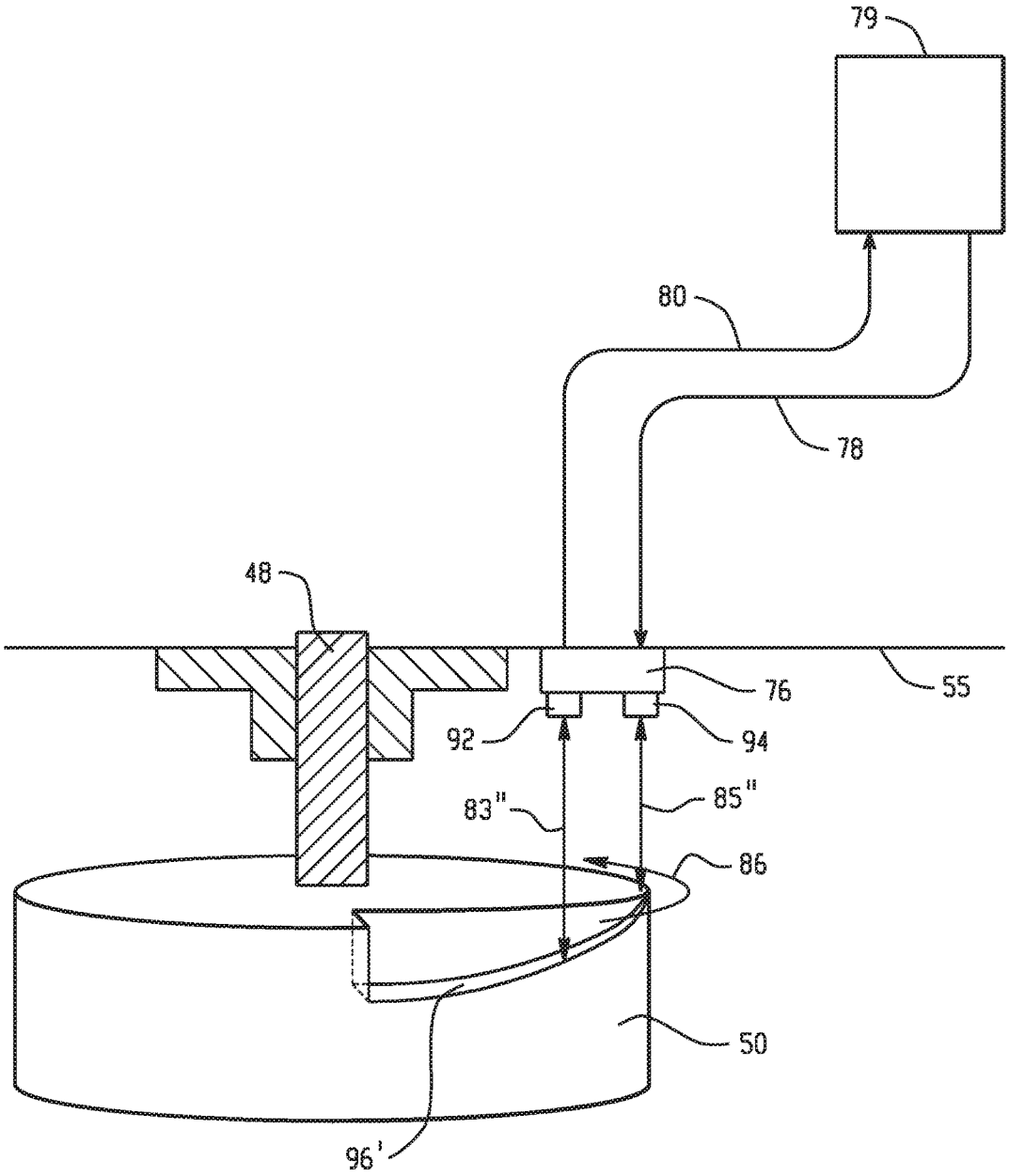
FIG. 5 is a schematic side view of a portion of a vane position detection portion of a movable vane control system that includes a movable target having a variable distance surface portion.

In some embodiments, a surface portion configured to provide a variable distance between itself and a distance sensor can be attached to or included as part of the vane instead of on a movable member that extends through the turbine case. This allows the distance sensor to be positioned inside the turbine case where it has a direct view of the actual vane to remove the linkage through the turbine case as a potential source of measurement inaccuracy. Such an exemplary embodiment is depicted in FIG. 5, where vane 50 has a ramp portion 96' on a surface portion facing the distance sensor 76. Ramp portion 96' can be angled between 0° and 90° relative to the vane axis 89, or can even be an irregular shaped surface. When vane 50 rotates, the signal from measurement sensor 92 (or alternatively from a measurement waveguide such as in FIG. 3) will strike different spots on the ramped surface portion 96' depending on the degree of rotation of the vane 50, providing a measured distance 83" that varies as a function of the position of vane stem 48. Reference sensor 94 provides a signal to detect the distance 85" from the non-ramped surface portion of the vane 50.

In operation, controller 79 signals actuator 44 to actuate vane 50. Actuator 44 responds by actuating torque converter 56, which moves synchronization ring 58 and consequently moves vane arms 60 to rotate the vanes. Vane position sensor 52 sends a vane position signal representing sensed angular position of vane 50 to controller 79. Using the vane position signal and optionally an actuator position signal from an actuator position sensor (not shown), controller 79 can determine whether vane 50 is positioned correctly or if the angular position of variable vane 50 should be adjusted. Thus, angular position of vane 50 can be adjusted based on the position signal from vane position sensor 52. In some embodiments, controller 79 can use signals from a plurality of vane position sensors (e.g., 1-4 sensors) spaced around the turbine. In a more specific embodiment, four vane position sensors are used evenly spaced around the turbine.

The invention can be utilized on any adjustable airfoil blades in the gas turbine engine, including those in the relatively low temperature compressor section and those in the relatively high temperature turbine section that is exposed to combustion exhaust gases. Distance sensors such as RF sensors can be configured to be resistant to the conditions found in the turbine section of a gas turbine engine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A movable vane control system for use with a gas turbine engine having a turbine axis of rotation, comprising:

a plurality of turbine vanes in a gas flow path within a turbine case of the gas turbine engine, said vanes being rotatable along a vane axis to provide an angular adjustment of the vane with respect to the gas flow path;

an actuator operatively connected to the plurality of vanes; and a vane position sensor comprising a distance sensor configured to sense a first measured distance between the distance sensor and a first target on a vane surface portion or a surface portion connected to the vane, wherein the distance sensor is further configured to sense a second measured distance between the distance sensor and a second target, said second target arranged such that said second measured distance does not change as a function of an angular vane position, and further wherein the vane position sensor is in signal communication with a controller that determines the angular vane position based on a comparison of the first and second measured distances.

2. The system of claim 1, wherein the first target is connected to the vane.

3. The system of claim 2, wherein the first target comprises a first threaded member having threads in rotatable engagement with a second threaded member, wherein (a) one of the first and second threaded members is operatively connected to the vane such that it rotates about the vane axis in response to movement of the vane and the other of the first and second threaded members is rotationally fixed about the vane axis, and (b) one of the first and second threaded members is movable along the vane axis and is detectable by the distance sensor as the first target, and the other of the second threaded member is fixed with respect to movement along the vane axis and is detectable by the distance sensor as the second target.

4. The system of claim 3, wherein the distance sensor is mounted at a fixed distance from the first or second threaded member that is fixed along the vane axis.

5. The system of claim 3, wherein the distance sensor is mounted at a fixed distance from the first or second threaded member that is movable with respect to movement along the vane axis.

6. The system of claim 3, wherein the first threaded member is an outer threaded member affixed to the turbine case and the second threaded member is an inner threaded member operatively connected to rotate with the vane to provide movement of the second threaded member along the vane axis.

7. The system of claim 2, wherein the first target comprises a first member operatively connected to rotate with the vane, said first member including a first member target surface portion configured to provide the first measured distance between the first member target surface portion and the distance sensor that changes as a function of the angular position of the vane.

8. The system of claim 7, wherein the first member target surface portion includes a surface that is angularly offset by greater than 0° and less than 90° from the vane axis.

9. The system of claim 1, wherein the first target comprises the vane surface portion.

10. The system of claim 9, wherein the vane surface portion includes a surface that is angularly offset by greater than 0° and less than 90° from the vane axis.

11. The system of claim 1, wherein said plurality of vanes is disposed in a turbine section of the gas turbine engine.

12. The system of claim 1, wherein the distance sensor comprises a measurement distance sensor configured to detect the first measured distance between the measurement distance sensor and the first target, and a reference distance sensor configured to detect the second measured distance between the reference distance sensor and the second target.

13. The system of claim 1, wherein the distance sensor and the first target are disposed within the turbine case.

14. The system of claim 1, further comprising the controller in signal communication with the actuator and the vane position sensor, configured to determine an angular position of the first vane based on input from the distance sensor and to actuate the actuator in response to input from the vane position sensor to achieve a target angular position of the vane.

15. The system of claim 1, comprising a plurality of vane position sensors configured as the vane position sensor.

16. The system of claim 1, wherein the distance sensor is a microwave distance sensor.

17. A method of operating the system of claim 1, comprising actuating the actuator to rotate the vane toward a target angular position, measuring distance between the distance sensor and the first and second targets to determine actual angular position of the vane, and either confirming that the vane target angular position has been achieved or actuating the actuator again to rotate the vane toward the target angular position.

* * * * *